US006910919B1

(12) United States Patent
Hung

(10) Patent No.: US 6,910,919 B1
(45) Date of Patent: Jun. 28, 2005

(54) COAXIAL CABLE CONNECTOR HAVING INTEGRAL HOUSING

(76) Inventor: Chen-Hung Hung, No. 26, Lane 88, Fu-Shing Rd., Chung-Le Tsun, Ming-Shiung Hsiang, Chia-Yi Hsien (TW)

( * ) Notice: Subject to any disclaimer, the term of this patent is extended or adjusted under 35 U.S.C. 154(b) by 0 days.

(21) Appl. No.: 10/867,661

(22) Filed: Jun. 16, 2004

(51) Int. Cl.[7] ..... H01R 9/05
(52) U.S. Cl. ..... 439/578; 439/584
(58) Field of Search ..... 439/578, 580, 439/584, 585

(56) References Cited

U.S. PATENT DOCUMENTS 3,498,647 A * 3/1970 Schroder ..... 285/343
3,764,959 A * 10/1973 Toma et al. ..... 439/584
5,024,606 A * 6/1991 Ming-Hwa ..... 439/578
5,470,257 A * 11/1995 Szegda ..... 439/578
5,529,522 A * 6/1996 Huang ..... 439/460
6,331,123 B1 * 12/2001 Rodrigues ..... 439/584
6,517,379 B2 * 2/2003 Leve ..... 439/578
6,776,657 B1 * 8/2004 Hung ..... 439/578
2004/0259416 A1 * 12/2004 Kodama et al. ..... 439/578

* cited by examiner

*Primary Examiner*—Hae Moon Hyeon
(74) *Attorney, Agent, or Firm*—Troxell Law Office, PLLC

(57) ABSTRACT

A connector comprises an integral housing comprising a mouth at one end, a recess inside the mouth, and an internal shell projected toward the recess for forming an annular cavity between the shell and the recess; and a hollow resilient member confined in the mouth. Inserting a coaxial cable into the shell will project the central conductor from the housing, cause the shell to penetrate a junction between the insulating medium and the outside conductor, receive the insulating medium in the shell, bend the outside conductor to cover a portion of the outermost insulating sleeve, and urge the resilient member against the insulating sleeve for securing the resilient member to the cable. Further, the housing is rotatable about the resilient member and the cable.

3 Claims, 4 Drawing Sheets

COAXIAL CABLE CONNECTOR HAVING INTEGRAL HOUSING

FIELD OF THE INVENTION

The present invention relates to connectors and more particularly to an improved coaxial cable connector having an integral housing such that the manufacturing processes can be simplified and a tool is not necessary in mounting a coaxial cable therein.

BACKGROUND OF THE INVENTION

Coaxial cable connectors are well known and are widely used in many applications. A conventional coaxial cable connector 10 is shown in a sectional view of FIG. 1. The connector 10 comprises a hollow, cylindrical member 11, a cylindrical shell 12 coaxially provided in the cylindrical member 11, and a rotatable nut 13 mounted on one end of the cylindrical member 11. A cable (not shown) has its end inserted into a channel 14 formed by the cylindrical member 11 with both the central conductor and the adjacent insulating medium of the cable disposed in the shell 12 and the outside conductor and the outermost insulating sleeve thereof disposed between the shell 12 and the cylindrical member 11. A tool such as pliers is used to press the cylindrical member 11 to cause it to have a hexagonal section so as to secure the connector 10 to the cable.

However, the prior art suffered from a couple of disadvantages. For example, a tool is required and this may bring inconvenience if the tool is not available at work. Further, the constituent components such as the cylindrical member 11, the shell 12, and the nut 13 are separate prior to assembly. That is, the assembly process may be a time consuming and labor intensive one. Thus, the need for improvement still exists.

SUMMARY OF THE INVENTION

It is an object of the present invention to provide a coaxial cable connector having an integral housing such that the manufacturing processes can be simplified and a tool is not necessary in mounting a coaxial cable therein.

To achieve the above and other objects, the present invention provides a connector comprising an integral, hollow, cylindrical housing comprising a forward, hollow, cylindrical member having a diameter slightly smaller than that of the housing, the cylindrical member having internal threads, an intermediate hexagonal member, a rear member including an inner recess having a first diameter and a mouth having a second diameter larger than the first diameter, and a reduced diameter internal member having a shell projected toward the recess for forming an annular cavity between the shell and the recess; and a hollow resilient member confined in the mouth; whereby inserting one end of a coaxial cable into the shell through the resilient member and the recess will project a central conductor of the cable from one end of the cylindrical member, cause the shell to penetrate a junction between an insulating medium and an outside conductor of the cable, receive an insulating medium of the cable in the shell, bend the outside conductor to cover an end portion of an outermost insulating sleeve of the cable, and urge the resilient member against the insulating sleeve for securing the resilient member to the cable; and securing the cylindrical member to an external element will rotate the housing about the resilient member and the cable.

In one aspect of the present invention, the resilient member comprises a toothed section bent inwardly such that snapping the resilient member onto a shoulder between the recess and the mouth and bending the mouth inwardly will form an annular flange proximate the toothed section for confining the same.

In another aspect of the present invention, the resilient member has a section of C and comprises an intermediate cylindrical member having a plurality of parallel, concave members interconnected both ends, and an inwardly bent toothed section at the other end, and wherein the outside conductor is elastically urged by the concave members and the toothed section is elastically urged against the insulating sleeve.

The above and other objects, features and advantages of the present invention will become apparent from the following detailed description taken with the accompanying drawings.

DETAILED DESCRIPTION OF THE PREFERRED EMBODIMENTS

Figure 1:
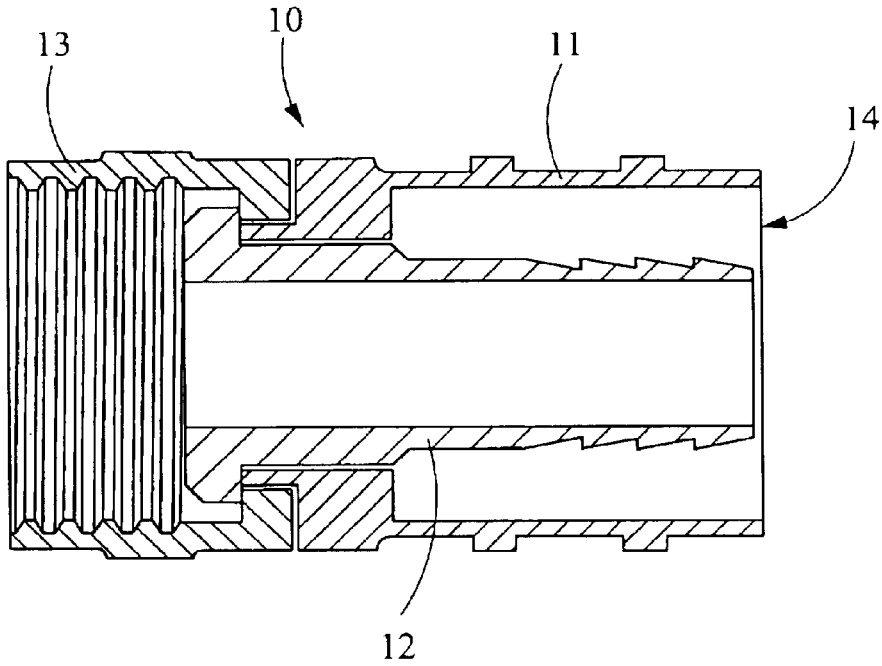
FIG. 1 PRIOR ART
FIG. 1 is a sectional view of a conventional coaxial cable connector.
Figure 2A:
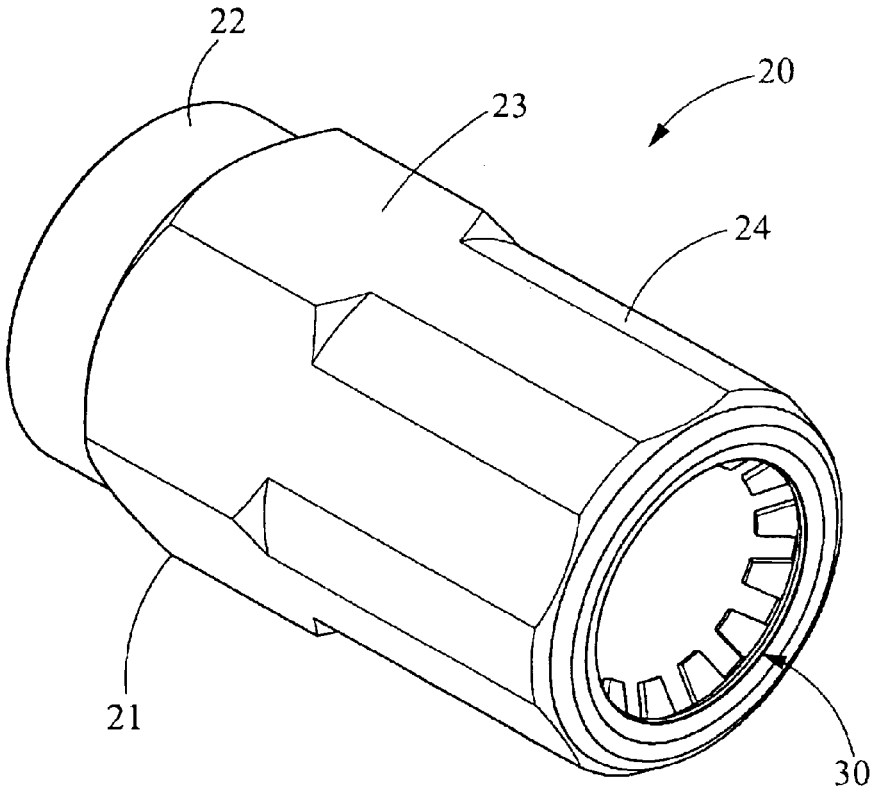
FIGS. 2A and 2B are perspective and sectional views of a coaxial cable connector according to the invention respectively.
Figure 4:
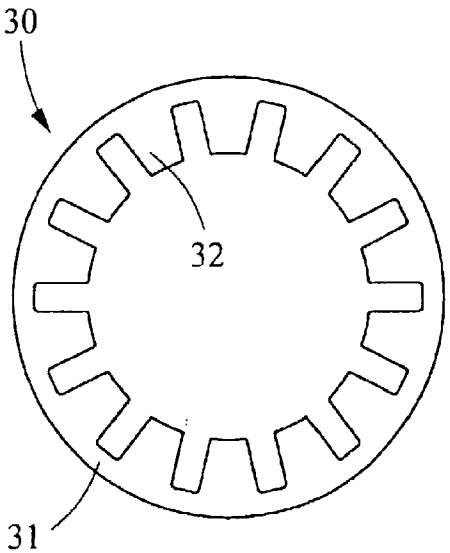
FIG. 4 is a front view of the resilient member.
Figure 2B:
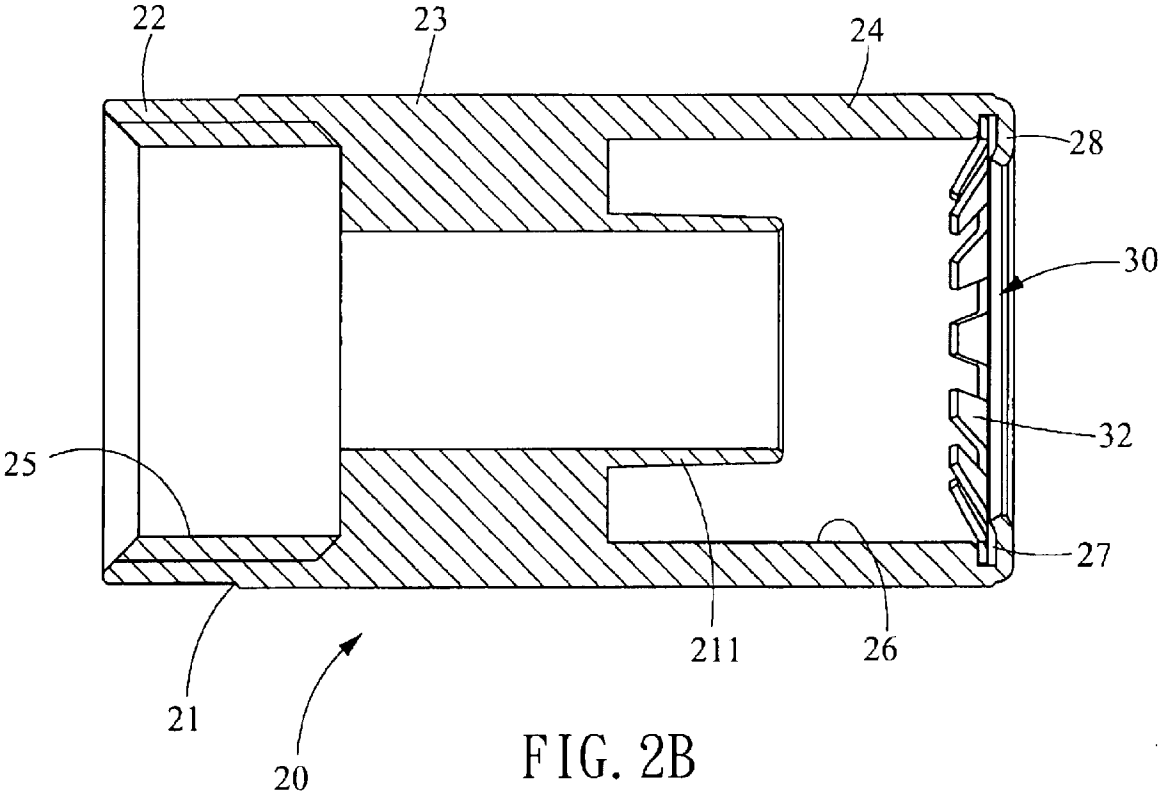
Figure 3:
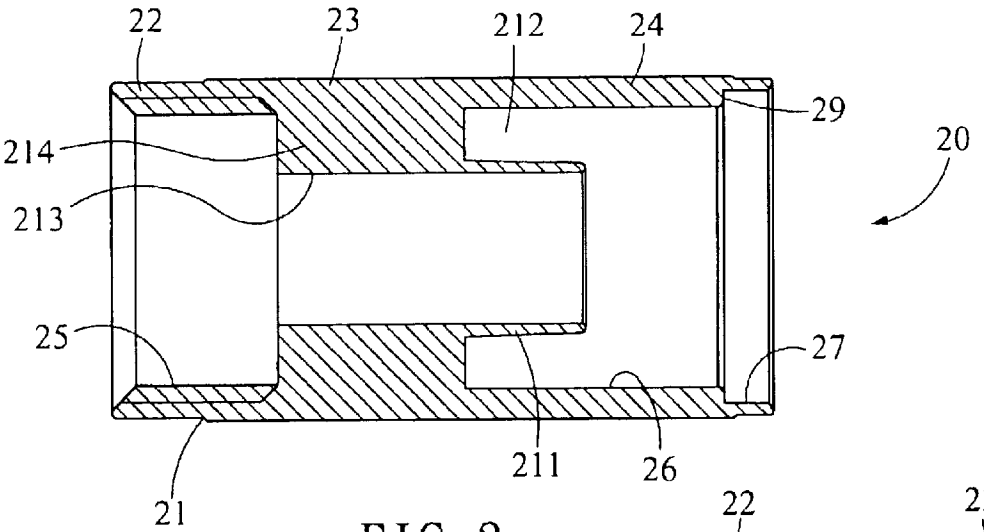
FIG. 3 is a view similar to FIG. 2B with the resilient member being removed.

Referring to FIGS. 2 to 5, there is shown a coaxial cable connector 20 constructed in accordance with the invention comprising an integral, hollow, cylindrical housing 21 including a forward, hollow, cylindrical member 22 having a diameter slightly smaller than that of the housing 21, internal threads 25 formed on an inner wall of the cylindrical member 22 for threadedly securing to an element, a hexagonal member 23 formed on an intermediate portion of the housing 21 such that a tool (e.g., pliers) can grasp thereon, a rear member 24 including an inner recess 26 having a smaller diameter and a mouth 27 having a larger diameter, a shoulder 29 between the recess 26 and the mouth 27, and a hollow, cylindrical shell 211 projected from an inner edge of an internal member 214 of the housing 21 a small distance toward the recess 26 so as to form an annular cavity 212 between the shell 211 and the recess 26.

The invention further comprises an annular resilient member 30 including an outer section 31 and an inner bent, toothed section 32. For mounting the resilient member 30 at the other end of the housing 21, snap the resilient member 30 onto the shoulder 29. Next, bend the mouth 27 inwardly by means of a tool to form an annular flange 28 proximate the outer section 31 for confining the resilient member 30 in the mouth 27.

Figure 5:
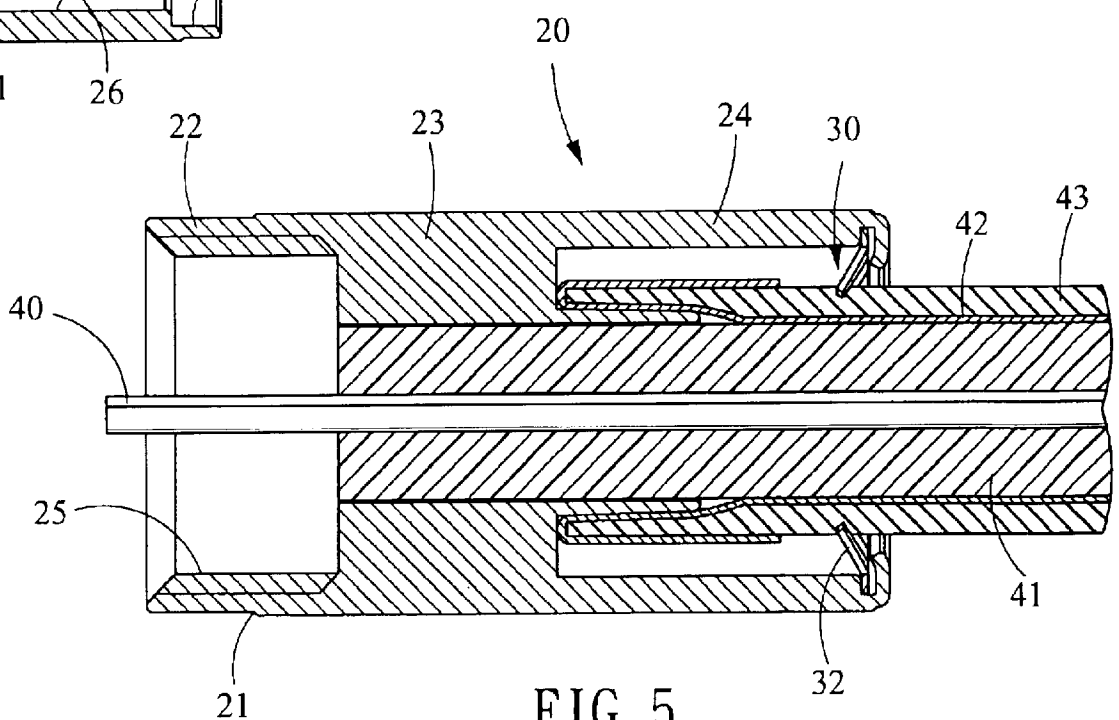
FIG. 5 is a sectional view of the connector of FIG. 2A with a cable fastened therein.

As shown in FIG. 5, for mounting a cable in the connector, insert one end of the cable into the bore 213 of the shell 211 through the toothed section 32 and the recess 26 until the central conductor 40 slightly projects from one end of the cylindrical member 22 and the shell 211 penetrates the junction between the insulating medium 41 and the braided outside conductor 42 a sufficient distance. As such, the insulating medium 41 is tightly received in the shell 211, the outside conductor 42 is bent to cover an end portion of the outermost insulating sleeve 43 in the cavity 212 and the recess 26, and the toothed section 32 is elastically urged against the outer surface of the insulating sleeve 43. As a result, the resilient member 30 and the cable are secured together. Further, the housing 21 is adapted to rotate about the resilient member 30 and the cable when the threads 25 are securing to an element.

Figure 6:
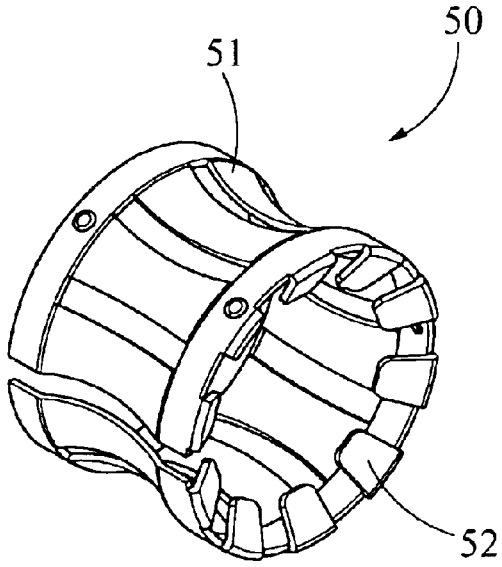
FIG. 6 is a perspective view of another preferred embodiment of resilient member according to the invention.
Figure 7:
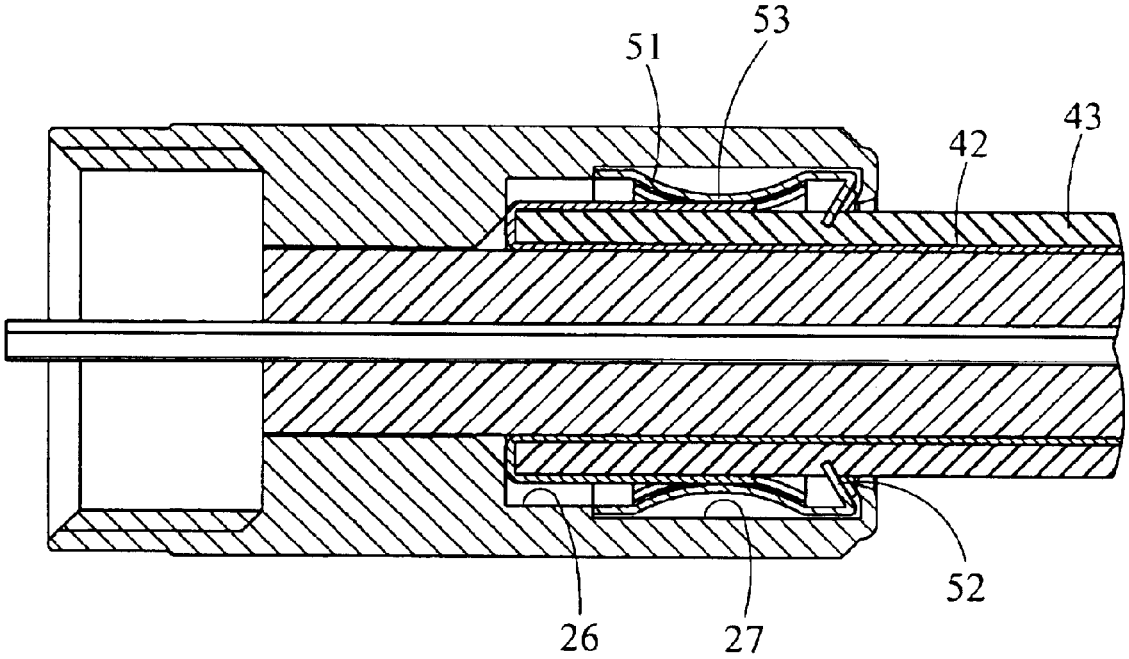
FIG. 7 is a sectional view of the connector of FIG. 6 with a cable fastened therein.

Referring to FIGS. 6 and 7, another preferred embodiment of resilient member 50 according to the invention is shown. The resilient member 50 is disposed in the mouth 27 and is a hollow, cylindrical member having a lengthwise gap, a plurality of parallel, concave members 51 interconnected both ends thereof, and an inwardly bent toothed section 52 at the other end thereof. The outside conductor 42 is elastically urged by contacts 53 of the concave members 51 and the toothed section 52 is elastically urged against the outer surface of the insulating sleeve 43. As a result, the resilient member 50 and the cable are fastened together. Also, the housing 21 is adapted to rotate about the resilient member 50 and the cable when the connector is securing to an element.

While the invention herein disclosed has been described by means of specific embodiments, numerous modifications and variations could be made thereto by those skilled in the art without departing from the scope and spirit of the invention set forth in the claims.

What is claimed is:

1. A connector comprising:

an integral, hollow, cylindrical housing comprising a forward, hollow, cylindrical member having a diameter slightly smaller than that of the housing, the cylindrical member having internal threads, an intermediate hexagonal member, a rear member including an inner recess having a first diameter and a mouth having a second diameter larger than the first diameter, and a reduced diameter internal member having a shell projected toward the recess for forming an annular cavity between the shell and the recess; and a hollow resilient member confined in the mouth; whereby:

inserting one end of a coaxial cable into the shell through the resilient member and the recess will project a central conductor of the cable from one end of the cylindrical member, cause the shell to penetrate a junction between an insulating medium and an outside conductor of the cable, receive an insulating medium of the cable in the shell, bend the outside conductor to cover an end portion of an outermost insulating sleeve of the cable, and urge the resilient member against the insulating sleeve for securing the resilient member to the cable; and securing the cylindrical member to an external element will rotate the housing about the resilient member and the cable.

2. The connector of claim 1, wherein the resilient member comprises a toothed section bent inwardly such that snapping the resilient member onto a shoulder between the recess and the mouth and bending the mouth inwardly will form an annular flange proximate the toothed section for confining the same.

3. The connector of claim 1, wherein the resilient member has a section of C and comprises an intermediate cylindrical member having a plurality of parallel, concave members interconnected both ends, and an inwardly bent toothed section at the other end, and wherein the outside conductor is elastically urged by the concave members and the toothed section is elastically urged against the insulting sleeve.

* * * * *